United States Patent [19]

Masahiko

[11] 4,136,544

[45] Jan. 30, 1979

[54] COOLING TUBES FOR WIRE STOCKS

[75] Inventor: Yamada Masahiko, Yokosuka, Japan

[73] Assignee: Showa Electric Wire & Cable Co., Ltd., Kawasaki, Japan

[21] Appl. No.: 829,372

[22] Filed: Aug. 31, 1977

[30] Foreign Application Priority Data

Aug. 31, 1976 [JP] Japan ..... 51-104164

[51] Int. Cl.[2] ..... B21B 45/02; C21D 1/64

[52] U.S. Cl. ..... 72/201; 266/113

[58] Field of Search ..... 72/45, 201, 286; 134/9, 134/15, 64 R, 122 R; 148/153, 156; 266/111, 112, 113, 114

[56] References Cited

U.S. PATENT DOCUMENTS

| | | | |
|---|---|---|---|
| 1,211,277 | 1/1917 | Bloom | 134/122 R |
| 1,844,135 | 2/1932 | Morgan | 134/122 R |
| 2,624,178 | 1/1953 | Bedson | 134/9 X |
| 3,895,139 | 7/1975 | Brown et al. | 148/156 X |

FOREIGN PATENT DOCUMENTS

| | | | |
|---|---|---|---|
| 557568 | 8/1932 | Fed. Rep. of Germany | 266/112 |
| 83950 | 9/1971 | German Democratic Rep. | 266/112 |
| 410844 | 5/1974 | U.S.S.R. | 72/201 |

*Primary Examiner*—E. M. Combs

*Attorney, Agent, or Firm*—Fred Philpitt

[57] ABSTRACT

A cooling tube for cooling a hot rolled wire stock by cooling liquid is divided into a plurality of cooling sections by spaced apart partition members. Each partition member comprises a nozzle like rotary member having an axial passage for passing the wire stock. The inlet opening of the passage is circular having a diameter slightly larger than the major axis of the maximum oval cross-sectional configuration which is formed for the hot rolled wire stock when its size is changed, while the outlet opening is an oval having a major axis equal to the diameter of the inlet opening and a minor axis slightly larger than the diameter of the circular portion of the wire stock having the maximum diameter. The cross-sectional configuration of the passage gradually changes from the inlet opening to the outlet opening to prevent leakage of the cooling liquid.

3 Claims, 5 Drawing Figures

2
4
3'
3
5
B
A
IIB
IIA
10
1
W
6
7
8
9
11
12
13
14

11
12
8

10
11
8

8
10
12'
C
C

14'
16'
12'
8

COOLING TUBES FOR WIRE STOCKS

BACKGROUND OF THE INVENTION

This invention relates to a wire stock cooling tube and more particularly a wire stock cooling tube especially suitable for continuously cooling hot rolled wire stocks.

Where a hot rolled wire stock is cooled by causing it to run though cooling liquid the cooling liquid in contact with the surface of the wire stock forms a film of vapor and when the cooling liquid becomes a boiling heat state conduction is greatly reduced thereby impairing the cooling effect. Such boiling can be prevented by increasing the pressure of the cooling liquid.

In a prior art cooling tube for a wire stock the interior of the cooling tube is divided into a plurality of sections by means of partition members each provided with a perforation having a diameter slightly larger than that of the wire stock, and supply and discharge of the cooling liquid are made for respective sections for the purpose of increasing the liquid pressure in respective sections.

The perforation of each partition member has a circular cross-sectional configuration with the diameter gradually decreasing in the direction of running of the wire stock.

A hot rolling mill for reducing the diameter of a wire stock comprises a plurality of spaced mill stands with their direction of rolling of adjacent stands 90° dephased. Accordingly, the roll pair of the first mill stand rolls the wire stock to have an oval cross-section and the roll pair of the second stand rolls the wire stock in the direction of the major axis of the oval thus changing the cross-section of the wire stock into circular having a smaller diameter. Succeeding stands repeat rolling into oval and circular cross-sections until finally a wire stock having a desired diameter and circular cross-sectional configuration is produced.

In the hot rolling mill described above, change of the product diameter is done in the following manner. Where it is desired to decrease the diameter of the product, among a plurality of roll pairs, roll pairs not have been participated in the rolling operation are brought into operation. In order to avoid not to apply an excessively large load on a wire feed or take-up motor, the participation of such idle roll pairs should be made pair after pair while adjusting the wire take up speed. On the other hand, where it is desired to increase the product diameter, a desired number of roll pairs now participating in the rolling operation is rendered idle, again pair after pair. For this reason, when the diameter of the product is changed, it is inevitable to produce transition portions for the product where the cross-sectional configuration is oval.

SUMMARY OF THE INVENTION

Accordingly, it is an object of this invention to provide an improved cooling tube for a hot rolled wire stock capable of efficiently cool the wire stock.

Another object of this invention is to provide an improved cooling tube for cooling a hot rolled wire stock which can efficiently cool the wire stock and can be manufactured readily.

Still another object of this invention is to provide a novel cooling tube which can efficiently cool a hot rolled wire stock without damaging the same by friction.

According to this invention there is provided a cooling tube for a hot rolled wire stock of the type wherein the cooling tube is divided into a plurality of cooling sections by spaced partition members each having an opening for passing the wire stock, and each cooling section is provided with inlet and outlet for cooling liquid, characterized in that each partition member comprises a nozzle like rotary member having an axial passage for passing the wire stock, the inlet opening of the passage being circular having a diameter slightly larger than the major axis of the maximum oval cross-sectional configuration which is formed for the hot rolled wire stock when the size thereof is changed and the outlet opening of the passage being an oval having a major axis equal to the diameter of the inlet opening and a minor axis slightly larger than the diameter of the circular portion of the wire stock having the maximum diameter and wherein the cross-sectional configuration of the passage gradually changes from the inlet opening to the outlet opening in the axial direction of the passage.

DESCRIPTION OF THE PREFERRED EMBODIMENTS

Figure 1:
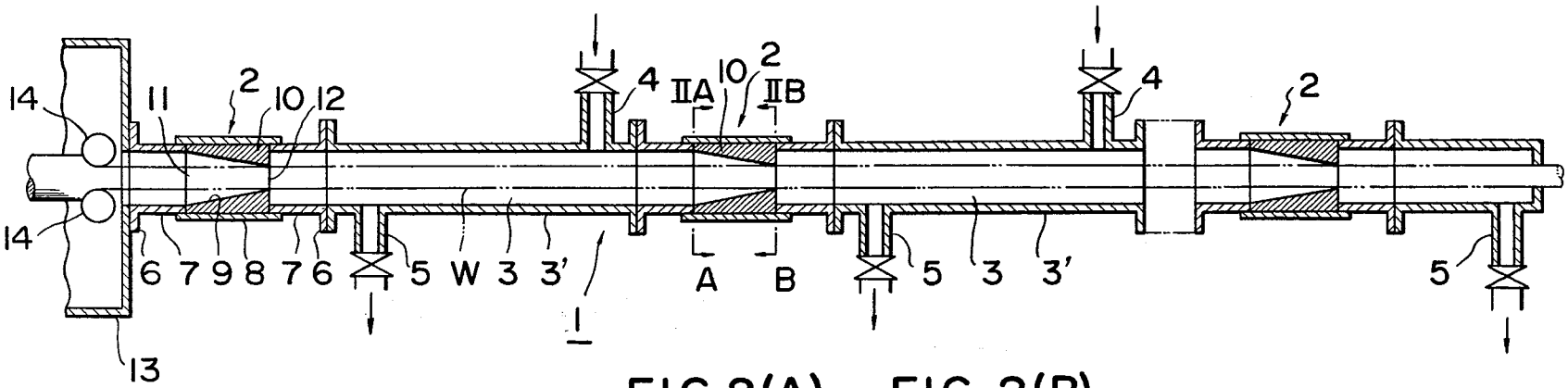
FIG. 1 is a longitudinal sectional view of one embodiment of the cooling tube of this invention.
Figure 2B:
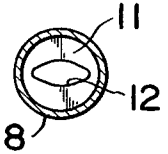
FIGS. 2A and 2B are cross-sectional views of the cooling tube shown in FIG. 1 respectively taken along lines IIa—IIa and IIb—IIb.
Figure 2A:
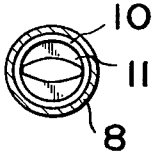

As shown in FIG. 1, a cooling tube 1 is divided into a plurality of sections 3 by partition members 2 having a construction as shown in FIGS. 2A and 2B. Each section is provided with an inlet port 4 and an outlet port 5 for cooling liquid.

Each section 3 comprises a central tube 3' and a pair of end tubes 7 connected to the central tube 3' by flanges 6. Opposed end tubes of adjacent sections are interconnected by an intermediate tube 8 having an inner diameter equal to the outer diameter of the end tubes 7. Inside the intermediate tube 8 is disposed a rotary nozzle like member 10 having an opening 9 to be described later, and acting as the partition member 2. As shown in FIG. 2A, the cross-sectional configuration of the inlet side of the opening 9 is a circle 11 having a diameter slightly larger than the major axis of the transition portions of the wire stock having an oval cross-sectional configuration whereas that of the outlet side is an ellipse 12 having a minor axis slightly larger than the maximum diameter of the wire stock having a maximum circular cross-section and a major axis equal to the diameter of the circular opening 11 at the inlet side. The sectional configuration of the opening 9 varies gradually between the inlet and outlet. The housing of the last mill stand including rolls 14 is designated by a reference numeral 13.

Since the partition member 10 is rotatable about the pass line of the wire stock, irrespective of the incoming angle of the transition portion having an oval cross-section formed at the time of changing the diameter of the wire and partition member 10 rotates to a position in which its inlet opening 11 aligns with the inclination angle of the cross-section of the wire stock thus permitting it to smoothly pass through the partition member. Moreover, since the gap between the inner surface of the partition member and the wire stock is kept small during the passing of the wire stock, the effect of the partition member will not be impaired. Although relatively large gaps are formed on both sides of the major axis of the elliptical opening 12 when a wire stock having a circular cross-section passes through the partition member, such gaps are smaller than those formed when the opening 12 is made to be a circle having a diameter equal to the major axis of the oval, whereby the effect of the partition member would not be impaired so much.

The nozzle members 10 are rotatable so that they can move to conform to any twisting of the wire passing therethrough. In other words, if the hot wire passing through the unit shown in FIG. 1 happens to be oval in shape (because of rolls 14) the angular disposition of this oval shape may change at least slightly as it moves from one end of the left end unit to the cooling unit to the right end of the cooling unit. Since nozzle members 10 are free to rotate, when the angular disposition of the oval-shaped hot wire does change, the oval-shaped outlet 12 of the nozzle member 10 will change it. Nozzle members 10 therefore automatically "match" any torsional twisting of the hot wire as it moves from the left end of the unit shown in FIG. 1 to the right end.

Nozzle members 10 do not have any function in changing the shape of the hot wire passing therethrough, but instead merely alternate the flow of cooling water between the hot wire and the surrounding tube.

Where the oval portion of the wire stock has a major axis of 23 mm, and a minor axis of 9.5 mm and where the wire stock having a circular cross-section has a maximum diameter of 16 mm and a minimum diameter of 9.5 mm, the partition member of the prior art construction has a circular opening having a diameter of 26 mm and a cross-sectional area of 530 $mm^2$ so that the area of the gap formed when the minimum diameter portion of 9.5 mm of the wire stock passes through the opening is about 460 $mm^2$.

For the same dimensions of the transition portions and the circular portions of the wire stock the partition member of this invention is designed such that its outlet opening 12 has a major axis of 26 mm, and a minor axis of 19 mm, that is a cross-sectional area of 345 $mm^2$. Accordingly, the area of the gap when the circular portion of the wire stock having a diameter of 9.5 mm passes through is 275 $mm^2$ which is much smaller than 460 $mm^2$ of the prior art construction.

As above described, according to this invention, the area of the gap formed when the wire stock having the minimum diameter passes through the partition member is much smaller than that of the prior art construction whereby the reduction in the pressure confining effect of the partition member can be limited to a small value. Accordingly, the reduction in the liquid pressure in each section is small whereby boiling of the cooling liquid can be effectively prevented.

Figure 3B:
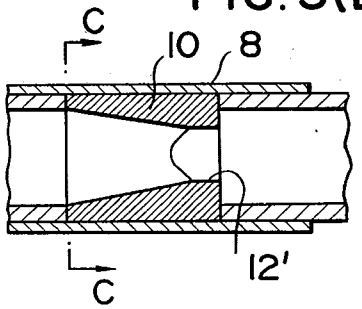
FIG. 3B is a longitudinal sectional view of the modified rotary partition member shown in FIG. 3A.

It will be clear that the invention is not limited the embodiment described above. For example, the outlet opening 12 of the rotary partition member 10 may have a construction as shown in FIG. 3. Although, the alternative outlet opening 12' has the same major axis and the minor axis as those of the outlet opening shown in FIG. 2B its cross-sectional configuration is diamond shape having a pair of opposed arcuate portions 14' having a spacing corresponding to the maximum diameter of the hot rolled wire stock and a pair of opposed arcuate portions 16' interconnecting the arcuate portions 14' and closely positioned to the end portions of the major axis of the maximum oval portion. In other words, small arcuate portions are located at the apices of the diamond of an acute angle, large arcuate portions are located at the apices of an obtuse angle, and these small and large arcuate portions are interconnected by relatively short segments. As shown in FIG. 3B, the outlet opening 12' has a certain axial length.

Figure 3A:
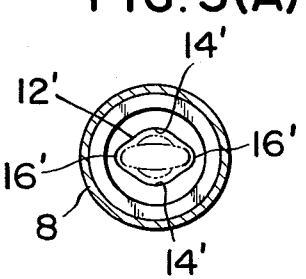
FIG. 3A is a cross-sectional view of a modified rotary partition member taken at the outlet opening.

The modified rotary partition member shown in FIGS. 3A and 3B is easier to manufacture than that shown in FIGS. 2A and 2B. In addition, since the outlet diamond shaped opening has a certain axial length, not only the damage to the wire blank due to friction is small, but also the pressure confining effect of the partition member can be improved.

I claim:

1. In a cooling tube arrangement for a hot rolled wire stock of the type wherein the cooling tube is divided into a plurality of cooling sections by spaced apart partition members, each partition member having an opening for the passage of the wire stock, and each cooling section being provided with inlet and outlet for cooling liquid, the improvement which comprises each partition member comprising a nozzle-like rotary member having an axial passage for passage of the wire stock, the inlet opening of each passage being circular and having an inlet diameter slightly larger than the major axis of the rolled wire stock entering said passage and the outlet opening of each passage having an oval shape having a major axis equal to the diameter of the inlet opening of said passage and a minor axis slightly larger than the minimum diameter of the wire stock passing therethrough and wherein the cross-sectional configuration of each passage gradually changes from its inlet opening to its outlet opening in the axial direction of said passage.

2. The cooling tube according to claim 1 wherein said outlet opening of a passage takes the form of a diamond having major and minor axes respectively equal to said major and minor axes and defined by a pair of opposed larger circular arcs, a pair of opposed smaller circular arcs, said larger and smaller circular arc being displaced 90°, and straight lines interconnecting said larger and smaller circular arcs respectively.

3. The cooling tube according to claim 1 wherein said exit opening has a predetermined length in the axial direction of said cooling tube.

* * * * *